US007513337B2

(12) United States Patent
Siikonen et al.

(10) Patent No.: US 7,513,337 B2
(45) Date of Patent: Apr. 7, 2009

(54) ELEVATOR SYSTEM

(75) Inventors: Marja-Liisa Siikonen, Helsinki (FI); Janne Sorsa, Helsinki (FI); Pentti Laihanen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/076,227

(22) Filed: Mar. 14, 2008

(65) Prior Publication Data

US 2008/0210493 A1 Sep. 4, 2008

Related U.S. Application Data

(63) Continuation of application No. PCT/FI2006/000295, filed on Sep. 5, 2006.

(30) Foreign Application Priority Data

Sep. 27, 2005 (FI) ..... 20050960

(51) Int. Cl.
*B66B 1/34* (2006.01)

(52) U.S. Cl. ..... 187/382

(58) Field of Classification Search ..... 187/247, 187/248, 380–388, 391, 393
See application file for complete search history.

(56) References Cited

U.S. PATENT DOCUMENTS 4,691,808 A 9/1987 Nowak et al.
5,229,559 A * 7/1993 Siikonen et al. ..... 187/391
5,252,790 A 10/1993 Aime et al.
5,612,519 A 3/1997 Chenais et al.
5,616,896 A * 4/1997 Kontturi et al. ..... 187/384
5,861,587 A * 1/1999 Powell et al. ..... 187/382
5,907,137 A * 5/1999 Tyni et al. ..... 187/382
5,923,004 A * 7/1999 Whitehall et al. ..... 187/382
5,932,852 A * 8/1999 Tyni et al. ..... 187/382

(Continued)

FOREIGN PATENT DOCUMENTS

FI 118215 B 8/2007

(Continued)

*Primary Examiner*—Jonathan Salata
(74) *Attorney, Agent, or Firm*—Birch, Stewart, Kolasch & Birch, LLP

(57) ABSTRACT

A method and a system for entering a destination floor call, for storing the call data of a destination floor call entered by the user, for allocating an elevator car to the user on the basis of the landing call data of the destination floor call and for transmitting a car call to the elevator car when the elevator is arriving at the landing. In the method, the user inputs a destination floor call using a destination call device. The destination floor call can be stored in the memory of the destination call device, in which case the call data transmitted to the control system comprises only the landing call, i.e. information specifying the user's starting floor and whether the destination floor given by the user is in the upward or downward direction. The destination floor call can also be transmitted directly to the elevator control system, which stores the call data of the destination floor call in the memory of the control system. The control system allocates an elevator suited to the user's requirements on the basis of the landing call data of the destination floor call. When the elevator car allocated to the user arrives at the floor, the control system transmits the a car call to the elevator serving the user.

14 Claims, 4 Drawing Sheets

U.S. PATENT DOCUMENTS

| | | | | |
|---|---|---|---|---|
| 6,401,874 | B2 * | 6/2002 | Siikonen | 187/382 |
| 6,644,442 | B1 * | 11/2003 | Ylinen et al. | 187/382 |
| 6,776,264 | B2 * | 8/2004 | Tyni et al. | 187/382 |
| 7,140,472 | B2 * | 11/2006 | Tyni et al. | 187/382 |

FOREIGN PATENT DOCUMENTS

| | | | |
|---|---|---|---|
| GB | 2 141 261 | A | 6/1984 |
| WO | WO-03/026997 | A1 | 4/2003 |
| WO | WO-2006/000118 | A1 | 1/2006 |

* cited by examiner

ELEVATOR SYSTEM

This application is a Continuation of copending PCT International Application No. PCT/FI2006/000295 filed on Sep. 5, 2006, which designated the United States, and on which priority is claimed under 35 U.S.C. § 120. This application also claims priority under 35U.S.C. § 119(a) on Patent Application No(s). 20050960 filed in Finland on Sep. 27, 2005. The entire contents of each of the above documents is hereby incorporated by reference.

FIELD OF THE INVENTION

The present invention relates to elevator systems. In particular, the present invention relates to a method for controlling an elevator system, in which method an elevator car suitable for the user is determined on the basis of the landing call data of a destination call entered by the user.

BACKGROUND OF THE INVENTION

In an elevator system, the operation of the elevators is controlled on the basis of calls entered by users. In a conventional elevator system, call input is in most cases arranged by placing on each floor of the building up/down buttons, by means of which an arriving passenger indicates the desired traveling direction. In addition, the elevator car needs to be provided with a control panel, on which the elevator passenger presses the button corresponding to his/her desired destination floor. In the traditional call input method, the elevator customer thus inputs two calls. First, a call button has to be pressed to call an elevator to the floor where the customer is currently located. In addition to this, a second press of a call button is needed in the elevator car.

An indicator light, which may have the shape of e.g. a direction arrow, is generally placed near the landing call buttons, i.e. near the up/down buttons outside the elevator car. A signal light lit in such a direction arrow indicates the traveling direction of an elevator having arrived at the floor. In addition, the landing may be provided with a digital number display placed beside or above the elevator door and continuously showing the floor at which the elevator is currently located.

Figure 1:
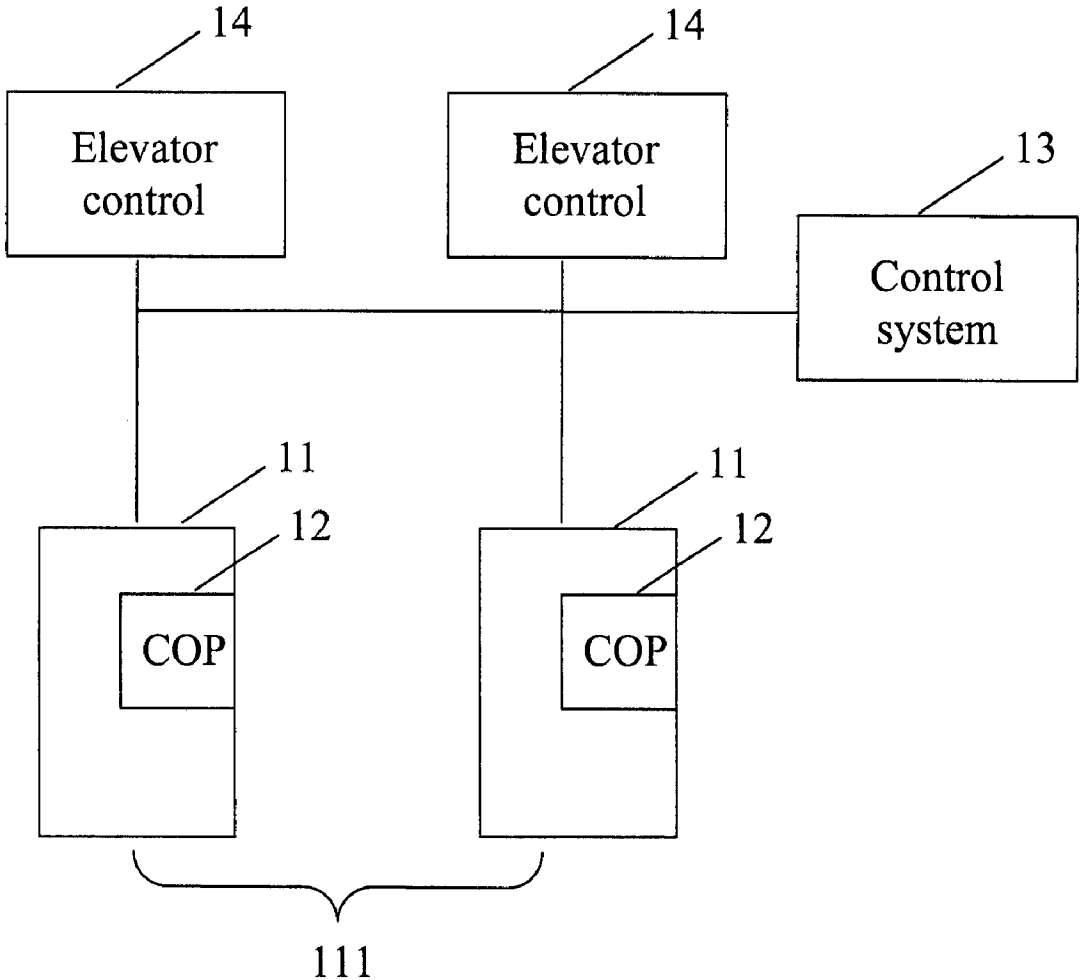

FIG. 1 presents the parts of a traditional elevator system, wherein an elevator group 111 in the elevator system comprises one or more elevator cars 11, an elevator control panel 12, an elevator group control system 13 and an elevator control system 14.

The elevator group control system 13 receives the landing call entered via the up/down buttons and tries to determine which one of the elevators in the elevator group will be best able to serve the person having entered the call. The landing call comprises information indicating the user's starting floor and whether the user is traveling in the upward or downward direction. The process of determining which elevator will be suitable for the user is termed call allocation. In continuous allocation, the control system 13 keeps continuously selecting, e.g. at half-second intervals, a suitable elevator for the user. Often a landing call is allocated to the elevator that is located closest to the user and traveling in the direction of the call. In continuous allocation, the actual selection of an elevator is not made until the elevator is so close to the floor of the call that it must begin to decelerate in order to stop. At this stage, the group control system 13 allocates the landing call to the stopping elevator car and transmits the received landing call to the elevator control system 14. Once the control system 13 has determined which elevator is to serve the user, the user can give his/her destination floor by pressing the desired button in the control panel 12. One of the advantages of continuous allocation is that, if an elevator traveling towards the user's starting floor stops before reaching the user's floor and remains stationary for some time, there may arrive from elsewhere another elevator that reaches the user's floor much earlier than that elevator car which seemed best at the time of entry of the landing call.

Figure 2:
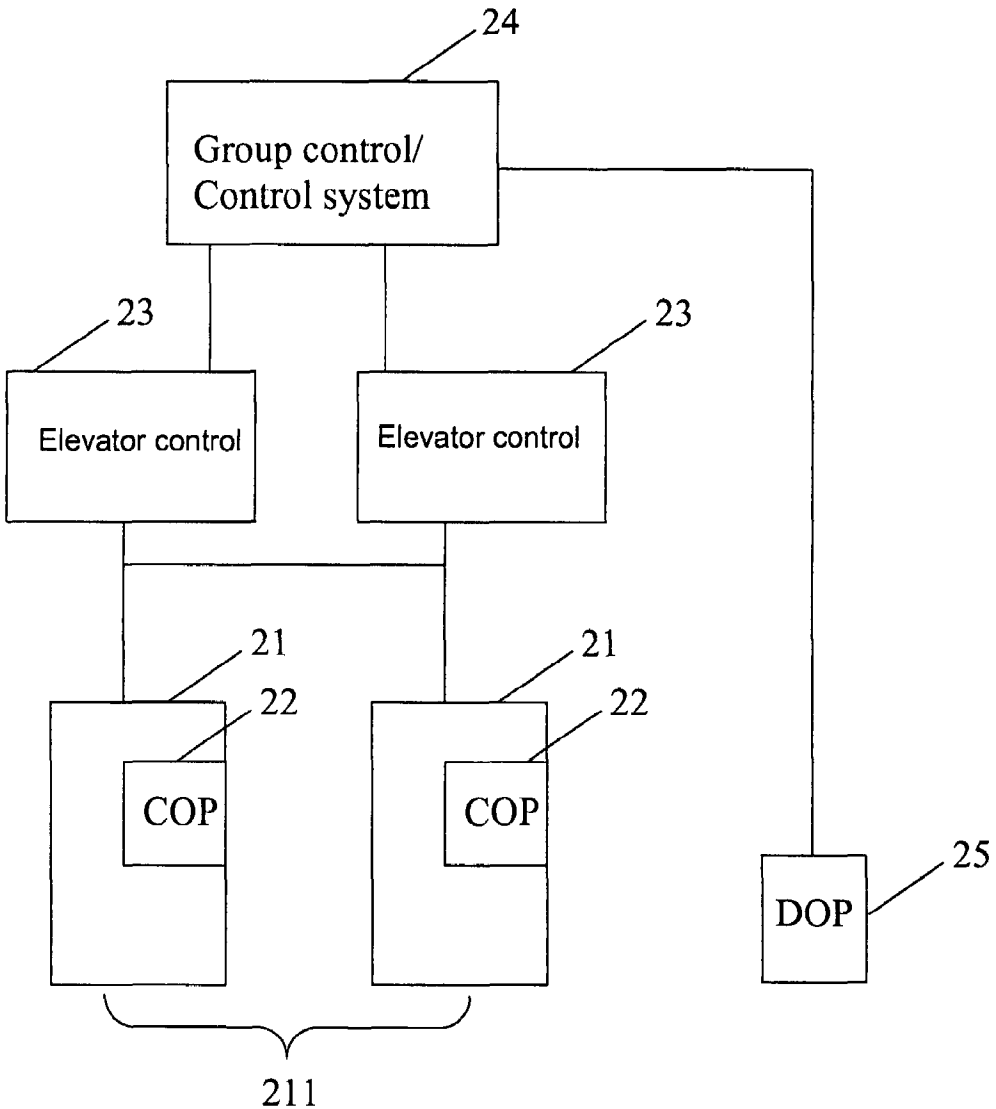

FIG. 2 presents an elevator system employing another call method. In the destination-floor elevator system according to FIG. 2, the user selects his/her destination floor already in the elevator lobby outside the elevator 21. In destination-floor elevator systems, each user wanting to have a ride on an elevator enters at the landing a destination floor call, which comprises information indicating the user's starting floor, destination floor and possibly some other information, such as the number of passengers or the like. In destination-floor elevator systems, the number of calls to be entered per elevator ride is one instead of the traditional two calls.

A destination floor call is entered e.g. using a destination call device 25 specifically reserved for this purpose, which is an expanded version of the traditional landing call button and is mounted at the landing. In the destination call device, the traditional landing call button has been expanded with a more versatile user interface so as to allow the user to directly indicate the floor he/she wants to reach by elevator. The destination floor call is transmitted for elevator allocation to the group control system, i.e. to the elevator control system 24, which immediately allocates an elevator to serve the user, specifically for each case e.g. on the basis of a genetic algorithm, and sends to the destination call device information regarding the elevator reserved for the user. Elevator allocation performed immediately is called single allocation. In this case, allocation takes place at the moment when the control system 24 receives a destination floor call from a user and the allocation is not changed afterwards. A simplified control panel 22 placed in the elevator car comprises e.g. a digital number display showing the floors at which the elevator is going to stop.

In traditional landing call allocation, it is difficult to utilize the entire transport capacity of the elevator group as well as simultaneous calls of a plurality of users. Neither is it possible in the traditional control method to optimize the total travel time of each passenger on a passenger-specific basis. By contrast, a destination-floor elevator system takes each passenger's total travel time and the number of users into account and can thus serve the users of the system more effectively. In a destination-floor elevator system, it is also possible to gather users with the same destination floor in the same elevator, thus allowing fast and efficient operation of the elevator system. However, the elevator control needed in a destination-floor elevator system requires for group control a very complex control system, which is not necessary in smaller elevator systems. The control tables required in a destination-floor elevator system also require plenty of memory storage space and are additionally impractical in respect of price in the case of smaller elevator systems.

Moreover, a destination-floor elevator system requires complicated signaling, such as displays mounted at the landings to let the user know in which direction the elevator selected to serve the call is moving and at which floors it will stop.

OBJECT OF THE INVENTION

The object of the present invention is to eliminate or alleviate the above-mentioned problems associated with prior art and to disclose a solution that is simple and easy to implement using traditional group control. A further object of the present invention is to disclose a solution that is cost-effective as compared to earlier solutions.

As for the features of the invention, reference is made to the claims.

BRIEF DESCRIPTION OF THE INVENTION

The object of the invention is to present a method for entering a destination floor call, for storing the call data of a destination floor call entered by the user, for allocating an elevator car to the user on the basis of the landing call data of the destination floor call and for transmitting a car call to the elevator car when the elevator is arriving at the landing. The method of the invention is characterized by what is presented in the characterization part of claim 1. The system of the invention is characterized by what is presented in the characterization part of claim 9. Other embodiments of the invention are characterized by what is disclosed in the other claims. Inventive embodiments are also presented in the description part and drawings of the present application. The inventive content disclosed in the application can also be defined in other ways than is done in the claims below. The inventive content may also consist of several separate inventions, especially if the invention is considered in the light of explicit or implicit sub-tasks or in respect of advantages or sets of advantages achieved. In this case, some of the attributes contained in the claims below may be superfluous from the point of view of separate inventive concepts. Within the framework of the basic concept of the invention, features of different embodiments of the invention can be applied in conjunction with other embodiments.

In an embodiment of the invention, the user enters a destination floor call using a destination call device. The call data of the destination floor call entered by the user are stored in the memory of the destination call device. The landing call data of the destination floor call comprise information indicating the user's starting floor and whether the user is traveling in the upward or downward direction. Moreover, the call data comprise information indicating the user's destination floor. The destination call device transmits the call entered by the user to a traditional elevator control system as a landing call indicating the user's starting floor and whether the destination floor given by the user is located upwards or downwards from the starting floor.

The elevator group control allocates a suitable elevator car to the user on the basis of the landing call data, using continuous allocation or single allocation. If the control system uses continuous allocation, then the user is informed e.g. by an optical and/or acoustic signal as to which elevator is going to serve him/her as the elevator arrives at the landing. When single allocation is applied, the user is informed regarding the elevator to serve him/her immediately e.g. via the destination call device. When the elevator car arrives at the landing, the destination call device transmits, based on the call data stored from the destination floor call, information regarding the user's destination floor to the elevator control system, which transmits a car call further to the elevator car.

In another method according to the invention, the user again enters a destination floor call via a destination call device. In this example, the user's destination floor call entered via the destination call device is transmitted directly to the elevator control system, which stores the call data of the destination floor call in the memory of the control system. The control system allocates a suitable elevator to the user on the basis of the landing call data of the destination floor call, using continuous allocation or single allocation. If the control system uses continuous allocation, then the user is informed regarding the elevator to serve him/her e.g. by an optical and/or acoustic signal when the elevator arrives at the landing. When single allocation is applied, the user is informed regarding the elevator to serve him/her immediately via the destination call device. When the elevator car arrives at the landing, the control system sends to the elevator car a car call telling the elevator to which floor the user is traveling.

In an embodiment of the invention, the floors served by the elevators are divided into different zones. For example, if the elevator group comprises four elevators, it is possible to configure two of the elevators to serve the lower floors and the other two to serve the upper floors. When an elevator passenger comes to the entrance floor, the elevator control system uses zoning data in elevator allocation, because an elevator can only be stopped at certain floors of the system. In this case, the call entered is only transmitted to an elevator for which the zone definition includes the destination floor in question. In this way, more efficient elevator operation can be achieved e.g. in up-peak conditions as the number of floors served by an elevator is reduced.

In an elevator system according to the invention, a destination floor call entered by a user can be served by using a simple elevator control system. In the method of the invention, the user can enter a call as a destination floor call, in which case he/she only needs to enter a call once, whereupon the control system takes care of call allocation so as to respond to the call and bring a car to the user's destination floor.

The solution disclosed also has the advantage of making it unnecessary to install expensive and complicated processors in the control system to take care of call allocation. According to the invention, the system responsible for allocation does not need a corresponding control system requiring a large storage and computing capacity; instead, allocation of calls is performed on the basis of the landing call data contained in the traditional destination floor call. In this way, the service level of the elevator system can be further improved without expensive and complicated control systems.

The system of the present invention is easy to install even in existing systems because no large and time-consuming changes need to be made in the existing control system. It is also possible to install storage space as well as a simple destination floor call processing function in existing destination call devices.

LIST OF FIGURES

Figure 3:
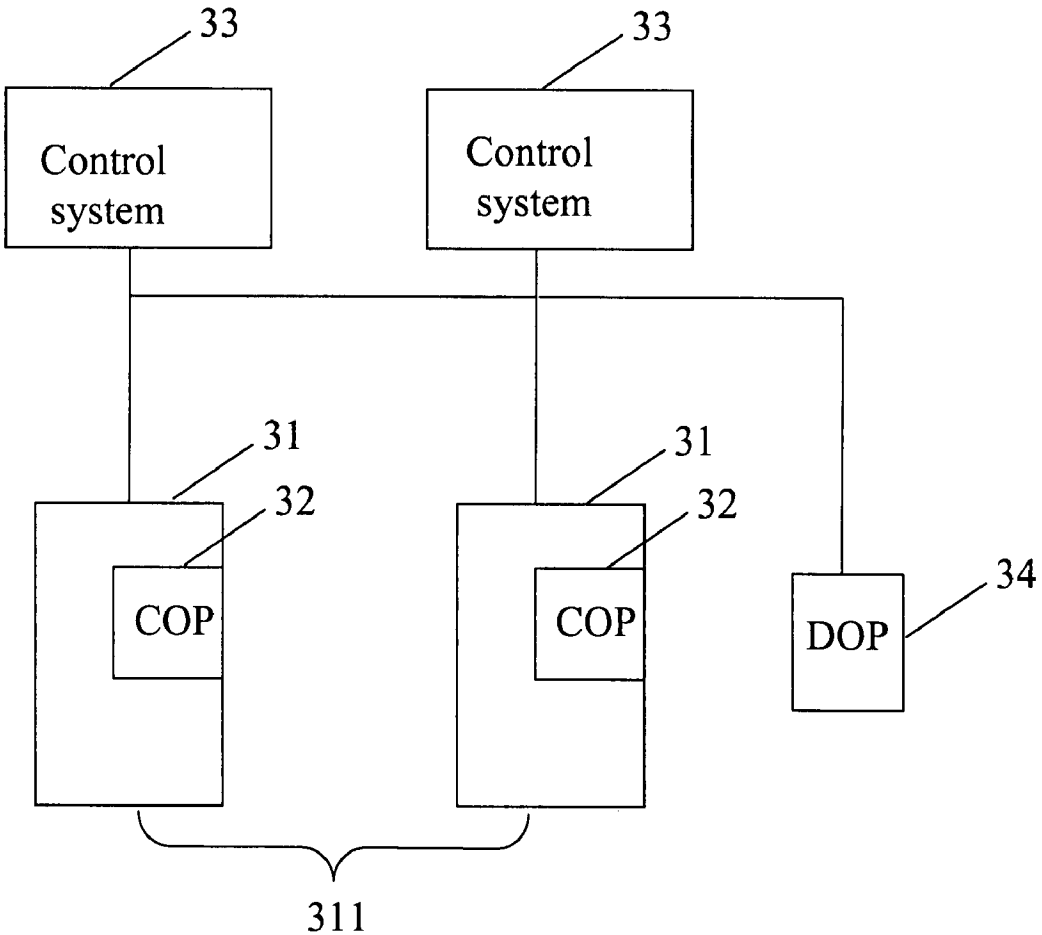
Figure 4:
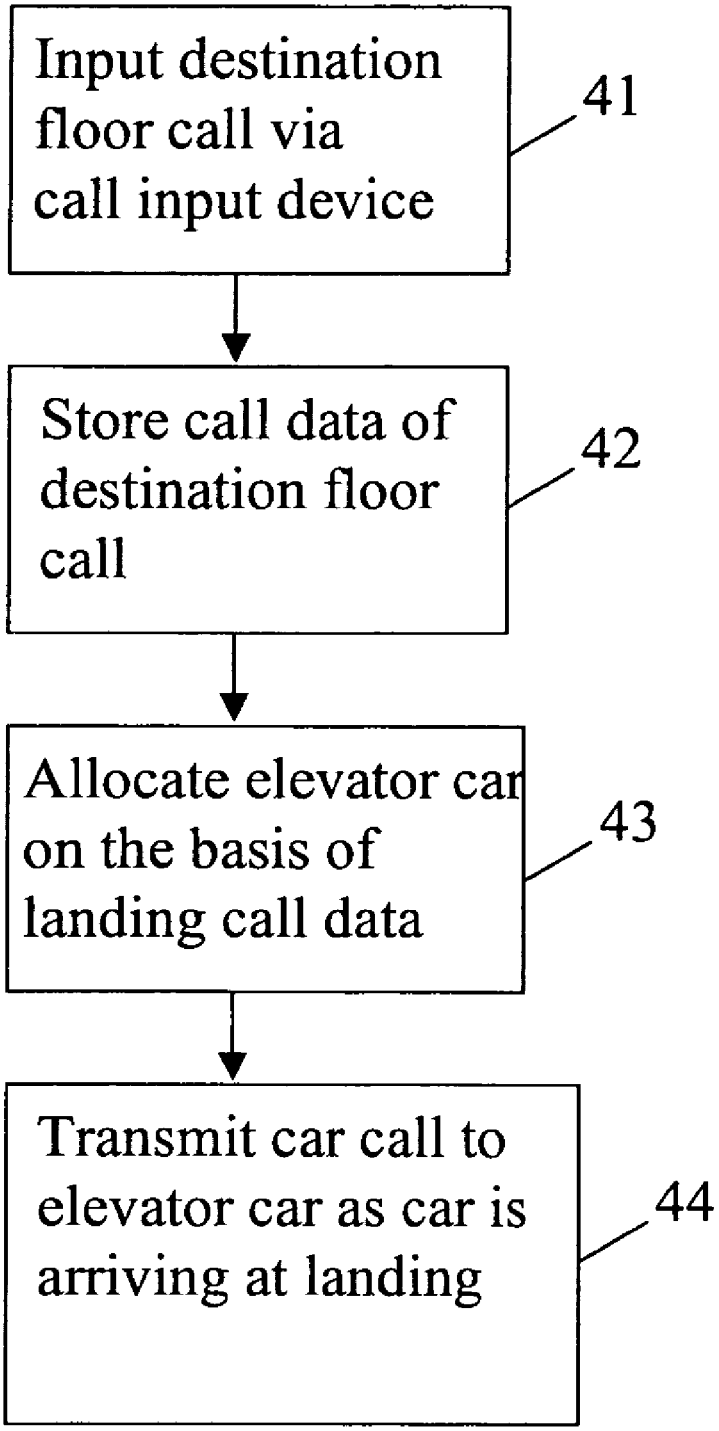

FIG. 1 presents a traditional elevator system, wherein the user inputs a landing call from a landing and a destination floor only from inside an elevator car, FIG. 2 presents another prior-art elevator system, wherein the user inputs both a landing call and an indication of the destination floor by a single destination floor call, FIG. 3 presents an embodiment of the elevator system of the invention, wherein the user enters a single destination floor call containing landing call data on the basis of which the control system allocates a suitable elevator to the user, and FIG. 4 presents a functional block diagram of a method according to the invention in a simplified form.

DETAILED DESCRIPTION OF THE INVENTION

FIG. 3 presents an elevator system according to the invention, said system comprising: an elevator group 311 including several elevators 31, a destination call device 34 for reserving elevators for use by passengers, and a control system 33 of the elevator group 311.

According to the invention, the user of the elevator system enters a destination floor call via the destination call device 34 as he/she comes to the elevator landing.

According to the invention, the destination call device 34 stores the destination floor call and transmits the call to the control system 33 of the elevator group 311 as a landing call, the call only indicating to the control system the user's starting floor and whether the user is traveling in the upward or downward direction (i.e. the landing call data). The destination floor call can also be transmitted directly as such to the control system 33, in which case the control system 33 stores the call and picks out the landing call data from it.

In principle, the control system 33 comprises separate elevator control and group control. However, only one group control of the control system is active at a time. The control system 33 performs elevator allocation on the basis of the landing call data of the destination floor call using either continuous allocation or single allocation. When the selection of the elevator car is performed by continuous allocation, the control system 33 continuously observes the positions of the elevator cars and distributes landing calls to the elevator group. When an elevator car is stopping at a floor, it is allocated a call entered by a user, and this call can be removed from the control system 33 after allocation has taken place. At the same time, the user is informed by an optical and/or acoustic signal as to which elevator will serve him/her. When the elevator has stopped at the floor, a car call based on the call data stored from the destination floor call is sent to the elevator control system and the elevator leaves for the destination floor.

The elevator allocation can also be performed immediately by the single allocation method, in which case the control system 33 allocates the most suitable elevator to the user directly on the basis of the landing call received. If the allocation is performed via single allocation, then information regarding the elevator allocated to the user is transmitted to the destination call device 34, where the user can read the information and thus knows which is the right elevator car for him/her to board. When the elevator car arrives at the floor, the landing call is removed from the control system 33, whereupon a car call (information regarding the destination floor) is transmitted to the elevator car.

FIG. 4 presents a functional block diagram of the method of the invention. In the method, the user inputs a destination floor call via a destination call device 41. The call data of the destination floor call entered by the user are stored 42 in memory. This can be done in two different ways. According to a first alternative, the destination floor call entered by the user is stored in the memory of the destination call device, in which case the call data transmitted to the control system comprises only the landing call, i.e. information specifying the user's starting floor and whether the destination floor given by the user is in the upward or downward direction. According to a second alternative, the destination floor call entered by the user via the destination call device is transmitted to the elevator control system, which stores the destination floor call in the memory of the control system. The control system allocates an elevator suited to the user's requirements on the basis of the landing call 43 of the destination floor call. When the elevator car allocated to the user arrives at the floor, then, if the destination floor call has been stored in the destination call device, the information regarding the destination floor comprised in the destination floor call is transmitted to the control system, which transmits the car call further to the elevator car 44. On the other hand, if the destination floor call has been stored in the control system, then, when the elevator car allocated to the user arrives at the floor, the control system picks out the car call from the stored call data of the destination floor call and transmits it further to the elevator car 44.

Although the elevator system specifically discussed in the above examples is a destination-floor elevator system, the invention can be applied in other elevator systems as well. Neither is the invention exclusively limited to the embodiment examples described above; instead, many variations are possible within the inventive concept defined in the claims.

The invention claimed is:

1. Method for controlling an elevator system, said elevator system comprising:

an elevator group (311) comprising a plurality of elevator cars (31), a destination call device (34) for reserving an elevator car (31) for use by passengers, a control system (33) of the elevator group (311) for controlling the elevator cars (31), said control system being responsive to the aforesaid destination call device (34), characterized in that the method comprises the steps of:

entering (41) a destination floor call via a destination call device (34), storing the call data (42) of the destination floor call, allocating (43) an elevator car for the user on the basis of the landing call data of the destination floor call, the landing call comprising information indicating the user's starting floor and traveling direction, and transmitting the destination floor of the stored call data as a car call to the allocated elevator car only as it is arriving at the landing (44).

2. Method according to claim 1, characterized in that the method further comprises the steps of:

storing the call data of the destination floor call in the destination call device (34), and transmitting the call data of the destination floor call from the destination call device to the control system.

3. Method according to claim 1, characterized in that the method further comprises the step of:

transmitting the destination floor call from the destination call device (34) to the control system (33), and storing the call data of the destination floor call in the control system (33) of the elevator group (311).

4. Method according to claim 1, characterized in that an elevator car is allocated to the user by continuous allocation.

5. Method according to claim 4, characterized in that the user of the elevator system is informed about the allocated elevator car by a signal light as the elevator car is arriving at the landing.

6. Method according to claim 1, characterized in that an elevator car is allocated to the user by single allocation.

7. Method according to claim 6, characterized in that the user is informed about the elevator allocated to the user by data transmitted immediately to the destination call device in response to the destination floor call entered by the user.

8. Method according to claim 1, characterized in that the elevator cars are assigned zones determining the floors to be served by each elevator car for persons arriving to the entrance floor.

9. Elevator system comprising:

an elevator group (311) comprising a plurality of elevator cars (31), a destination call device (34) for reserving an elevator car (31) for use by passengers, a control system (33) of the elevator group (311) for controlling the elevator cars (31), said control (33) system being responsive to said destination call device (34), characterized in that the aforesaid destination call device (34) has been arranged to receive a destination floor call, the system comprises means (34, 33) for storing the call data of the destination floor call, the aforesaid control system (33) of the elevator group (311) has been arranged to allocate (43) an elevator car to the user on the basis of the landing call data of the destination floor call, the landing call data comprising information indicating the user's starting floor and traveling direction, and the aforesaid control system (33) of the elevator group (311) has been arranged to transmit the destination floor of the stored call data as a car call to the allocated elevator car only as it is arriving at the landing (44).

10. Elevator system according to claim 9, characterized in that the aforesaid destination call device (34) has been arranged to store the destination floor call, and to transmit the landing call data of the destination floor call from the destination call device to the control system.

11. System according to claim 9, characterized in that the aforesaid destination call device (34) has been arranged to transmit the destination floor call to the control system (33), and the aforesaid elevator control system (33) has been arranged store the destination floor call.

12. System according to any claim 9, characterized in that the aforesaid control system (33) has been arranged to allocate an elevator car to the user by using continuous allocation.

13. System according to claim 9, characterized in that the aforesaid control system (33) has been arranged to allocate an elevator car to the user by using single allocation.

14. System according to claim 9, characterized in that the aforesaid destination call device (34) has been arranged to receive data regarding the elevator serving the user immediately in response to the destination floor call entered by the user.

* * * * *